US008469762B2

(12) United States Patent
Kim et al.

(10) Patent No.: US 8,469,762 B2
(45) Date of Patent: Jun. 25, 2013

(54) HIGH INTENSITY DISCHARGE ARC LAMP USING UV-ABSORBANT COATING

(75) Inventors: Kyekyoon Kim, Champaign, IL (US); Ju Gao, Champaign, IL (US); Hyungsoo Choi, Champaign, IL (US); Ravindra Pratap Singh, Hillsboro, OR (US)

(73) Assignee: The Board of Trustees of the University of Illinois, Urbana, IL (US)

( * ) Notice: Subject to any disclaimer, the term of this patent is extended or adjusted under 35 U.S.C. 154(b) by 0 days.

(21) Appl. No.: 12/601,445

(22) PCT Filed: May 22, 2008

(86) PCT No.: PCT/US2008/064518
§ 371 (c)(1),
(2), (4) Date: Jun. 16, 2010

(87) PCT Pub. No.: WO2008/147878

PCT Pub. Date: Dec. 4, 2008

(65) Prior Publication Data

US 2010/0301730 A1 Dec. 2, 2010

Related U.S. Application Data

(60) Provisional application No. 60/939,613, filed on May 22, 2007.

(51) Int. Cl.
*H01J 9/00* (2006.01)

(52) U.S. Cl.
USPC ..... 445/26; 427/160; 313/489

(58) Field of Classification Search
USPC ..... 313/483–493, 623, 627–643, 567, 313/111–117, 25–27, 318.01–318.09; 439/615, 439/739; 445/24, 26, 29, 22; 427/160, 458, 427/475, 479, 480, 485–486
See application file for complete search history.

(56) References Cited

U.S. PATENT DOCUMENTS

| | | | | | |
|---|---|---|---|---|---|
| 3,531,677 | A * | 9/1970 | Loughridge | ..... | 313/112 |
| 4,006,378 | A * | 2/1977 | Silverstein et al. | ..... | 313/112 |
| 4,179,542 | A * | 12/1979 | Christofas et al. | ..... | 428/324 |
| 4,210,687 | A * | 7/1980 | Obendorf et al. | ..... | 428/34.7 |
| 5,221,876 | A * | 6/1993 | Bergman et al. | ..... | 315/82 |
| 5,243,251 | A * | 9/1993 | Inukai et al. | ..... | 313/25 |
| 5,344,676 | A * | 9/1994 | Kim et al. | ..... | 427/468 |
| 5,608,227 | A | 3/1997 | Dierks et al. | | |
| 5,646,472 | A * | 7/1997 | Horikoshi | ..... | 313/112 |
| 6,032,871 | A * | 3/2000 | Borner et al. | ..... | 239/3 |
| 6,174,213 | B1 * | 1/2001 | Paz de Araujo et al. | ..... | 445/58 |
| 2006/0110544 | A1 * | 5/2006 | Kim et al. | ..... | 427/458 |

(Continued)

FOREIGN PATENT DOCUMENTS

JP 03276102 A * 12/1991

OTHER PUBLICATIONS

Day et al., "Simultaneous Generation and Deposition of Cobalt Nanoparticles by Flow-Limited Field-Injection Electrostatic Spraying for Catalytic Growth of Single-Walled Carbon Nanotubes", Nanotechnology Materials and Devices Conference 2006. IEEE PI Oct. 22, 2006, pp. 486-487, XP031221385.

(Continued)

*Primary Examiner* — Donald Raleigh
(74) *Attorney, Agent, or Firm* — Guntin & Gust, PLC; Andrew Gust

(57) ABSTRACT

A high intensity discharge arc lamp comprises an arc tube, a metal halide in the arc tube, and a coating on the arc tube. The coating comprises a UV absorbent material.

14 Claims, 5 Drawing Sheets

U.S. PATENT DOCUMENTS

| | | | | |
|---|---|---|---|---|
| 2007/0048452 | A1 * | 3/2007 | Feng et al. | 427/458 |
| 2009/0192323 | A1 * | 7/2009 | Morales et al. | 549/533 |

OTHER PUBLICATIONS

Gu et al., "Flow-Limited Field-Injection Electrostatic Spraying for Controlled Formation of Charged Multiple Jets of Precursor Solutions: Theory and Applications", Applied Physics Letters, American Institute of Physics, Melville, NY., vol. 87, No. 8, Aug. 18, 2005, pp. 84107-084107, XP012077586.

* cited by examiner

HIGH INTENSITY DISCHARGE ARC LAMP USING UV-ABSORBANT COATING

CROSS-REFERENCE TO RELATED APPLICATION

This application claims the benefit of provisional application No. 60/939,613 entitled "High Intensity Discharge Arc Lamp using UV-absorbant Coating" filed 22 May 2007, the entire contents of which are hereby incorporated by reference, except where inconsistent with the present application.

BACKGROUND

Discharge lamps, dosed with special radiating materials such as metal halides, are among the most efficient light sources mankind has ever made. Combined with high lumens output and excellent color balance, these light sources are used in general lighting illuminating buildings, streets, large facilities as well as special applications such as projectors and automobiles. Though the lamps have been engineered so that the majority of the radiation is in the visible range, which contributes to the high lumen efficacy, there is a significant portion of UV radiation that has to be filtered out. The filtering can be carried out by the fixture itself or by using an additional optical element; a light source without UV radiation would increase the usage of the light source and reduce the adverse impact of the UV radiation to the fixture materials.

$TiO_2$ is a common oxide that has widespread applications. Due to its wide band gap at around 3 eV, $TiO_2$ is effective in absorbing ultraviolet (UV) radiation that enables many UV-blocking applications. $TiO_2$ also possesses strong photo-catalytic effect; that is when it is irradiated by UV radiation, it produces OH and O radicals on the surface that are potent in breaking down dusty materials and destroying microbiological agents, inspiring self-cleaning and germicidal applications.

Flow-limited field-injection electrostatic spraying (FFESS) is a novel thin-film deposition method wherein field-injection charging using a nano-sharpened tungsten electrode inserted in an insulating nozzle produces electrostatic spray of precursor solutions. These charged nano-drops are subsequently accelerated toward a substrate (room-temperature or heated) for film deposition showing many advantages for the fabrication of thin films: (a) the electrostatic repulsion between the charged nanodrops delivered onto the substrate helps to produce homogeneous coating; (b) the very large specific surface area of the nanodrops makes the film deposition highly receptive to pyrolysis and annealing; (c) no vacuum is required for the deposition; (d) even relatively insulating solutions can be sprayed successfully because of the field-injected charge; (e) since field injection can generate high currents at low applied voltages giving rise to a high and uniform surface-charge density, multiple-jet sprays can be generated in a stable and reproducible manner giving more uniformity to spray distribution.

SUMMARY

In a first aspect, the present invention is a high intensity discharge arc lamp, comprising an arc tube, a metal halide in the arc tube, and a coating on the arc tube. The coating comprises a UV absorbent material.

In a second aspect, the present invention is a lamp housing, comprising a glass or quartz housing, and a coating on the housing. The coating comprises a UV absorbent material.

In a third aspect, the present invention is a method of making a lamp housing, comprising coating a glass or quartz housing with a UV absorbent material.

In a fourth aspect, the present invention is a method of making a high intensity discharge arc lamp, comprising coating a glass or quartz housing with a UV absorbent material; and forming a high intensity discharge arc lamp from the housing.

In a fifth aspect, the present invention is a method of reducing the UV light output of a high intensity discharge arc lamp, comprising coating the lamp housing with a UV absorbent coating.

DETAILED DESCRIPTION

We thus explore depositing a thin layer of $TiO_2$ directly on the plasma envelops known as the arc tubes for two main purposes. First, we wanted to filter out the UV radiation so that the lamps can be used directly without worrying about the harm that the UV radiation can cause. Second, we expected the photo-catalytic effect under the same UV radiation can self-clean the lamp and perhaps even add to the environment friendliness of the lamp. To enhance the latter effect, we devised to apply a nano-structured $TiO_2$ coating to increase the surface area. However, the complex structure of the lamp requires the coating to be conformal to achieve a uniform coating. We also had the practical need in mind that the coating may need to be applied in an open air, room temperature environment to handle the large scale and high yield desirable in actual production. Flow-limited field-injection electrostatic spraying, as mentioned below is well suited to meet all these demands.

The invention improves the quality of light output from HID (high intensity discharge) arc lamps.

The present invention produces a thin-film coating of UV-absorbent materials, with controlled surface morphology, on the external surface of a HID arc lamp to achieve enhanced performance. The thin films of the desired materials are deposited using the FFESS technique. Preferably, the UV-absorbent material contains a metal oxide, more preferably titanium oxide.

The present invention includes improving efficiency of high intensity discharge (HID) arc lamps with thin coatings of UV absorbent materials, and deposition using flow-limited field-injection electrostatic spraying (FFESS) to facilitate deposition of such coatings of highest quality at relatively low costs without use of clean rooms or vacuum chambers. The coating can have a thickness of 50 to 2000 nm, 100 to 1000 nm or 300 to 500 nm.

Figure 1:
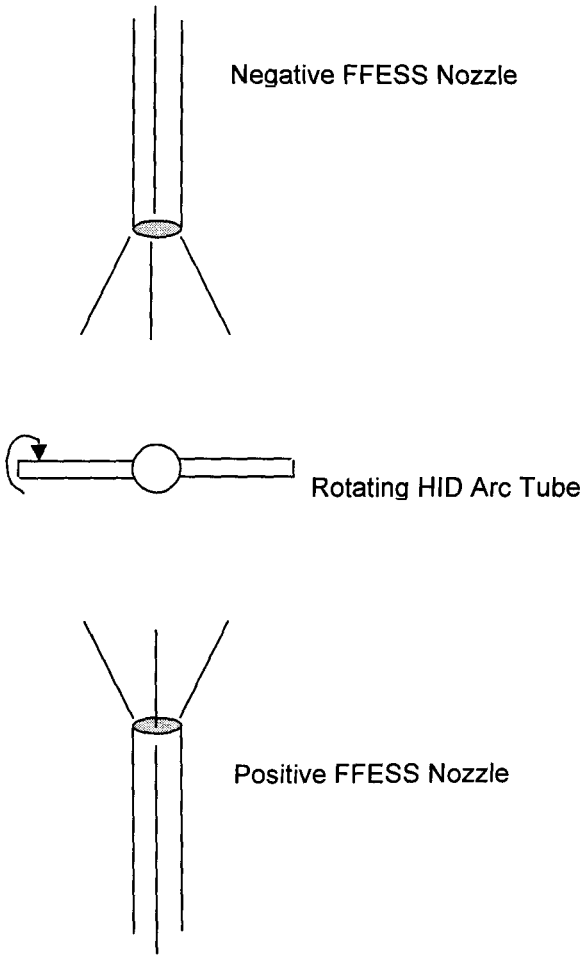
FIG. 1 illustrates a schematic of an experimental setup for coating on a quartz HID arc tube by rotating the tube between a positive and a negative FFESS nozzle spraying towards each other.

Approximately 300-500 nm thick coatings of $TiO_2$ precursor were deposited on the arc tubes by rotating the tube between a positive FFESS nozzle and a negative FFESS nozzle spraying towards each other (FIG. 1). Tube rotation helps expose all regions of tube surface to the positive and negative spray particles evenly, eliminating any charge build up on any portions of tube. Thus, even though the arc tube is non-conducting and non-grounded, it can receive the charged nanodroplets in a continuous manner for long durations.

Figure 2A:
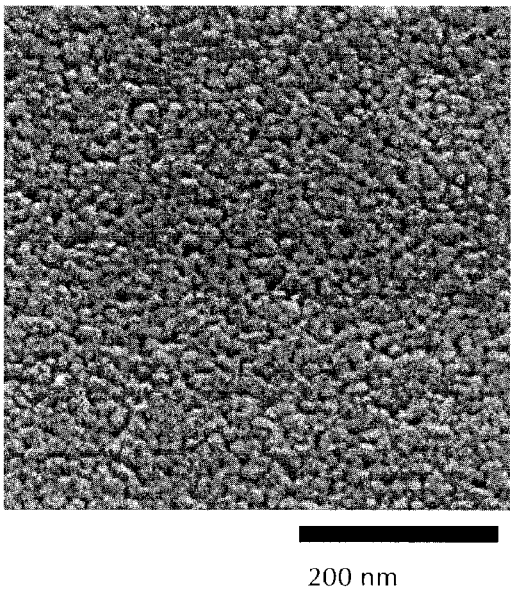
FIG. 2A represents an SEM micrograph of a $TiO_2$ coating.
Figure 2B:
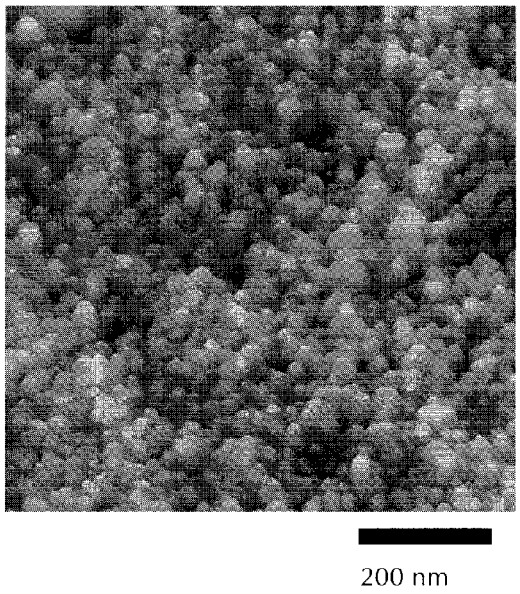
FIG. 2B represents an AFM micrograph of a $TiO_2$ coating.
Figure 3A:
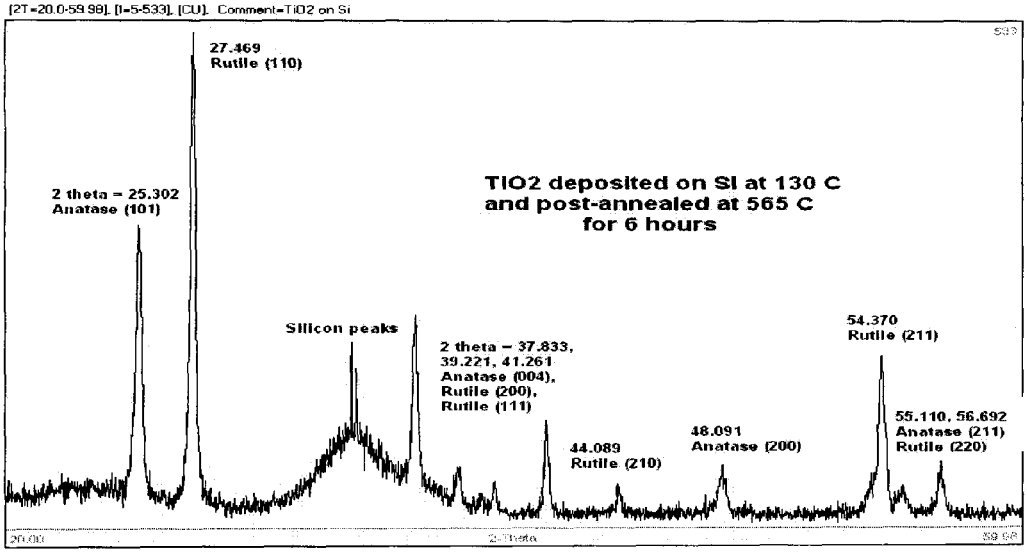
FIG. 3A depicts an X-ray diffraction plot of the titania coating on silicon indicating a presence of titania in anatase and rutile phases.
Figure 3B:
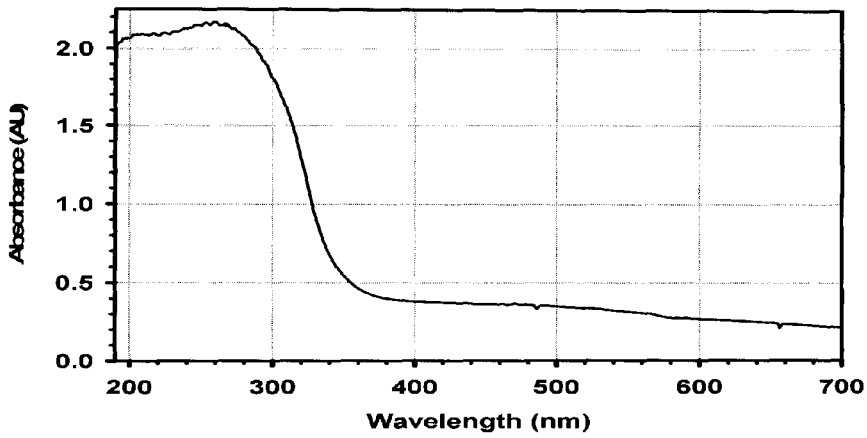
FIG. 3B depicts an absorption spectrum of $TiO_2$ on quartz.

The $TiO_2$ precursor coatings are converted into $TiO_2$ coatings when the lamp operates and the surface temperature increases causing annealing of the precursor. Coatings deposited on quartz substrates (the arc tube envelope may be quartz or glass) and annealed in the same manner indicate the presence of a smooth thin film on the surface as shown by SEM and AFM data in FIG. 2. XRD data for the same coating prepared on a silicon substrate is shown in FIG. 3, indicating the presence of both anatase and rutile phases of $TiO_2$. The optical absorption measurements with the quartz substrate show the absorption edge at about 320 nm (FIG. 3).

The metal oxide precursor can be selected from those commonly known in the art, for instance precursors used in the production of ceramics, spin coating and chemical vapor deposition. Useful metal oxide precursors include soluble compounds of the metals. Examples are organometallic metal oxide precursors such as alkoxides, alcoholates, acetylacetates and carboxylates; water-soluble metal oxide precursors such as acetates, halides and nitrates are also useful. Mixtures thereof may also be used.

Examples of metal oxide precursors are metal oxide precursors of metals such as Ti, Zn, Sn, Zr, Ni, Pb, Sr, Nb, Ta, Al, Sn, Fe, Ce, Mg, Y, Ba, Al and Hf. Mixtures of metal oxide precursors are also useful, and may be used for the addition of dopants or minority phases. Other metal complexes, such as metal acetates and other metal carboxylates, and metal acetylacetonates may also be used as metal oxide precursors. Specific example metal oxide precursors include: $Ti(i\text{-}Pro)_2(acac)_2$, $Ti(t\text{-}BuO)_4$, $Ti(i\text{-}Pro)_4$, $Si(OEt)_4$, $Zr(COOCH_3)_4$, $Mg(COOCH_3)_2$, $Y(C_5H_7O_2)_3$, $Pt(C_5H_7O_2)_2$, $SrCO_3$, $(NH_4)_x(WO_4)_y$, $Cu(C_5H_7O_2)_2$, $Nd(C_5H_7O_2)_3$, $Ni(C_5H_7O_2)_2$, $Co(C_5H_7O_2)_2$, $V(C_5H_7O_2)_3$, $Pd(C_5H_7O_2)_2$, $MgSO_4$, $AgNO_3$, $AlNO_3$, $ZnCl_2$, $ZrOCl_2$, $ZrO(OH)Cl$ and $MgCl_2$.

The coatings include UV-absorbent films on the exterior surface of the HID arc lamps. FFESS-based coating of thin films of materials has been previously described as follows:

K. Kim & C. K. Ryu, "Method and apparatus for producing nanodrops and nanoparticles and thin films therefrom," U.S. Pat. No. 5,344,676, Sep. 6, 1994.

K. Kim & Q. Feng "Method and apparatus for producing thin film and nano particle deposits," U.S. Pat. No. 5,948,483, Sep. 7, 1999.

K. Kim & Q. Feng "Method of producing thin film and nano particle deposits using charges of alternating polarity," U.S. Pat. No. 6,060,128, May 9, 2000.

Kyekyoon Kim and Ravindra Pratap Singh, "Electrohydrodynamic Spraying System," Patent Case No. 10322/67, OTM File No.: TF03108; Filed Nov. 22, 2004, published as Patent Application Publication, Pub. No. US 2006/0110544 (May 25, 2006).

C. K. Ryu and K. Kim, "Fabrication of ZnO thin films using charged liquid cluster beam technique", Applied Physics Letters, 67:22, 3337-3339, 1995.

K. Kim and C. K. Ryu, "Generation of charged liquid cluster beam of liquid-mix precursors and application to nanostructured materials," Nanostructured Materials, vol. 4, no. 5, pp. 597-602, 1994.

M. Cich, K. Kim, H. Choi, and S. T. Hwang, Deposition of $(Zn,Mn)_2SiO_4$ for plasma display panels using charged liquid cluster beam, Applied Physics Letters, 73:15, 2116, 1998.

S. H. Rhee, Y. Yang, H. S. Choi, J. M. Myoung, and K. Kim, Deposition of highly [100]-oriented MgO films at low temperature by charged liquid cluster beam, Thin Solid Films, 396, 23-28, 2001.

Hyungsoo Choi, Sungho Park, Yi Yang, HoChul Kang, Kyekyoon (Kevin) Kim, M. Y. Sung, and Ho G. Jang, Low-temperature fabrication of high-quality (Ba, Sr)$TiO_3$ films using charged liquid cluster beam method, J. Materials Research, 17:8, 1888-1891, 2002.

H. Kang, S. Park, H. Choi, K. Kim, M. Sung, "Low-Temperature Growth of Highly Crystalline (Ba, Sr)$TiO_3$ Films by Charged Liquid Cluster Beam Method", Electrochem. Solid-State Lett., 7, F77-F80, 2004.

H. Kang, S. Park, H. Choi, K. Kim, M. Sung, "$SrTiO_3$ Thin Films Deposited by Charged Liquid Cluster Beam Technique in Combination with Sol-Gel Processing", Electrochem. Solid-State Lett., 7, F70-F72, 2004.

Figure 4:
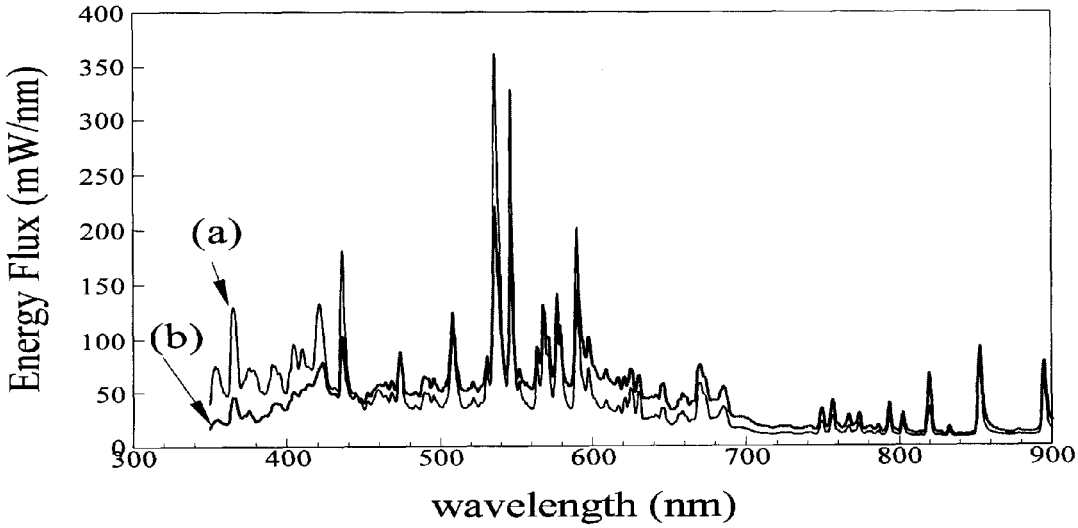
FIG. 4 depicts a spectrum of 68 W DC MHL before (a) and after (b) application of a $TiO_2$ coating.

The photometry measurements show that the UV portion of the spectrum is blocked by the film effectively. However, the results also show, more interestingly, that the visible portion of the spectrum is enhanced in the green to red region. FIG. 4 shows the spectra before and after the coating is applied. The result has been repeated in a 6 lamp group and shows the tendency consistently. Quantitatively, the following results are obtained (table 1): (1) the lumens output is increased by as high as 15%; the color rendering index (CRI) is improved from an average of 71 to 80; and (3) the color temperature drops from 5957K to 5092K. These are all positive features that improve the lamp.

TABLE 1

Average photometric results for 68 W DC metal halide lamps before and after $TiO_2$ coatings.

| | Lumens | Volts (V) | Current (A) | CRI | CCT (K) |
|---|---|---|---|---|---|
| Before coating | 5541 | 96 | 0.71 | 71 | 5957 |
| After coating | 5774 | 106.8 | 0.64 | 80 | 5092 |

A possible explanation of this unexpected benefit can be given as follows. The coating absorbs the UV radiation. It thus heats up the arc tube wall, perhaps uniformly. It then helps evaporate more metal salts that stick to cold spots. In other words, the UV energy is recycled to heat up the salts so that there are more radiators in the plasma. Another possible mechanism may be that the film reflects a good portion of the IR because of the large refractive index difference between the $TiO_2$ and quartz, even though it is just one layer of coating.

Figure 5:
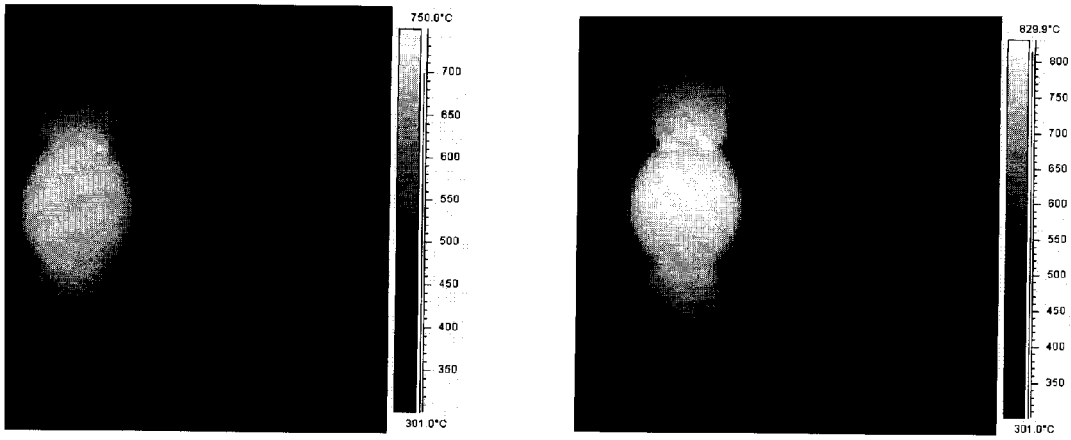
FIG. 5 depicts a thermal imaging of (a) uncoated and (b) $TiO_2$ coated lamps in operation.
Figure 6:
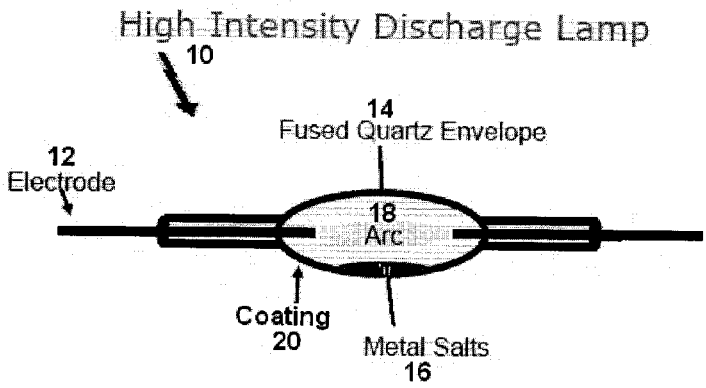
FIG. 6 is a schematic of a high-intensity discharge lamp 10, illustrating the lamp housing 14, the electrodes 12, reagents for the plasma 16, and during operation, the arc 18. In the present invention, a UV-absorbent coating 20 is also present on the housing.

We have direct evidence of wall temperature increase by using a thermal camera to measure the surface temperature. The measurement is straightforward on the arc tubes before and after the coating, as shown in FIG. 5.

As a result of the increased wall temperature and more salts being released into the plasma, we have observed the voltage to sustain the plasma, often referred to as the lamp voltage, increased due to the paschen curve. This means that by applying the same power, the current drops. Then the ohmic loss on the electrodes is reduced and more power is consumed by the plasma. In the end more power is used to produce light after we form the coating to change the plasma boundary conditions. Tests show that the coatings survive for over 2000 hours.

The invention claimed is:

1. A method, comprising:

rotating a housing of a lamp;

coating a surface of the housing of the lamp with negatively charged nanoparticles during the rotating, wherein the housing is a non-conductive material; and coating the surface of the housing of the lamp with positively charged nanoparticles during the rotating, wherein the positive and negative nanoparticles are substantially evenly distributed over the surface of the housing, wherein the housing is not grounded, and wherein the coating comprises a precursor material which, responsive to being subjected to heat from the lamp, anneals to form an ultraviolet absorbent material.

2. The method of claim 1, wherein the coating of the surface with the negatively and positively charged nanoparticles is performed using a plurality of flow-limited field-injection electrostatic spraying nozzles that apply the positively and negatively charged nanoparticles on the surface of the housing at the same time.

3. The method of claim 1, wherein the non-conductive material is glass or quartz, and wherein the coating with the negatively and positively charged nanoparticles is a continuous process performed at room temperature.

4. The method of claim 1, wherein the precursor material comprises a metal oxide.

5. The method of claim 1, wherein the coating has a thickness ranging from 50 to 2000 nm, and wherein the coating with the negatively and positively charged nanoparticles is performed without using a clean room and without using a vacuum chamber.

6. A method, comprising:

coating a surface of a housing with positively charged nanoparticles;

coating the surface of the housing with negatively charged nanoparticles, wherein the positive and negative nanoparticles are substantially evenly distributed over the surface of the housing; and forming a high intensity discharge arc lamp from the housing, wherein the positively and negatively charged nanoparticles comprise a precursor material which, responsive to being subjected to heat from the lamp, anneals to form an ultraviolet absorbent material.

7. The method of claim 6, wherein the housing is formed from a non-conductive material.

8. The method of claim 6, wherein the coating of the positively and negatively charged nanoparticles comprises rotating the housing while the positively and negatively charged nanoparticles are applied on the surface of the housing to substantially distribute the positive and negative nanoparticles evenly over the surface of the housing.

9. The method of claim 6, wherein the precursor material comprises one of $Ti(i\text{-}Pro)_2(acac)_2$, $Ti(t\text{-}BuO)_4$, or $Ti(i\text{-}Pro)_4$.

10. The method of claim 6, wherein the coating has a thickness ranging from 50 to 2000 nm.

11. A method, comprising:

coating a surface of a lamp housing with positively and negatively charged nanoparticles; and substantially distributing the positive and negative nanoparticles evenly over the surface of the lamp housing to prevent charge build up on a portion of the surface, wherein the coating comprises a precursor material which, responsive to being subjected to heat from a light source of the lamp housing, anneals to form an ultraviolet absorbent coating.

12. The method of claim 11, wherein the coating of the surface with the positively and negatively charged nanoparticles comprises rotating the lamp housing while a plurality of spraying nozzles apply the positively and negatively charged nanoparticles on the surface of the housing.

13. The method of claim 12, wherein the spraying nozzles include flow-limited field-injection electrostatic spraying nozzles.

14. The method of claim 11, wherein the precursor material comprises one of $Ti(i\text{-}Pro)_2(acac)_2$, $Ti(t\text{-}BuO)_4$, or $Ti(i\text{-}Pro)_4$, wherein the lamp housing is glass or quartz, and wherein the coating is between 300 to 500 nm thick.

* * * * *